US006538626B1

(12) United States Patent
Nieberger et al.

(10) Patent No.: US 6,538,626 B1
(45) Date of Patent: Mar. 25, 2003

(54) METHOD AND APPARATUS FOR ILLUMINATING TWO INDEPENDENT INDICATORS WITH A SINGLE OUTPUT PIN

(75) Inventors: Mathew A. Nieberger, Rocklin, CA (US); Kristie Amanna, Roseville, CA (US); Terry W. Smith, Rescue, CA (US)

(73) Assignee: Hewlett-Packard Company, Palo Alto, CA (US)

( * ) Notice: Subject to any disclaimer, the term of this patent is extended or adjusted under 35 U.S.C. 154(b) by 271 days.

(21) Appl. No.: 09/626,530

(22) Filed: Jul. 27, 2000

(51) Int. Cl.[7] ..... G09G 3/14
(52) U.S. Cl. ..... 345/46; 345/82; 340/815.45
(58) Field of Search ..... 345/39, 44, 46, 345/82, 83; 340/815.4, 815.45, 815.52, 815.65, 815.66, 815.67, 691.1, 691.4

(56) References Cited

U.S. PATENT DOCUMENTS 3,869,641 A * 3/1975 Goldberg
4,580,038 A * 4/1986 O'loughlin ..... 340/815.45
4,797,556 A 1/1989 Marzari et al. ..... 250/551
4,847,728 A * 7/1989 Youla ..... 340/815.45
4,924,177 A 5/1990 Mulz ..... 324/133
5,066,929 A * 11/1991 Frantz ..... 340/815.4
5,359,290 A 10/1994 Cervas ..... 324/384
5,633,651 A * 5/1997 Carvajal et al. ..... 340/815.45
5,874,930 A 2/1999 McRobert et al. ..... 345/44
5,959,413 A 9/1999 Komarek et al. ..... 315/306
6,037,874 A 3/2000 Heironimus ..... 340/686.1
6,198,405 B1 * 3/2001 Andersson et al. .... 340/815.45
6,265,985 B1 * 7/2001 Nieberger ..... 340/815.45
6,292,161 B1 * 9/2001 Andersson et al. .... 340/815.45

* cited by examiner

*Primary Examiner*—Regina Liang
(74) *Attorney, Agent, or Firm*—David M. Mason

(57) ABSTRACT

A display apparatus for selectively and independently controlling the illumination of two visual indicators with a single control line. The apparatus includes two visual indicators connected in parallel with the cathode to anode direction of one indicator being opposite the other indicator, and a logic circuit having two signal inputs and the control line. The control line couples to a first end of the two indicators. An inverter couples between the control line and a second end of the two indicators. A combination of signals applied to the two inputs selectively illuminates one of the two indicators with one signal from the control line.

19 Claims, 2 Drawing Sheets

METHOD AND APPARATUS FOR ILLUMINATING TWO INDEPENDENT INDICATORS WITH A SINGLE OUTPUT PIN

BACKGROUND OF THE INVENTION

1. Field of the Invention

The present invention generally relates to a display apparatus, and more particularly to an apparatus for independently controlling the illumination of two visual indicators with a single output pin of an integrated circuit.

2. Description of the Related Art

Most electronic devices today, such as a printer, modem, computer, server, pager, phone, etc., utilize visual indicators to display various operational conditions of the device to the user. In the same conventional devices, each visual indicator is independently driven using separate pins of an integrated circuit ("IC"). This type of conventional display apparatus is undesirable in that it is "pin constrained". In other words, an excessively large number of IC pins are required to drive a large scale display element or apparatus. Notably each additional pin in an application specific integrated circuit has a tangible cost associated to size and power characteristics of the IC package.

Another factor of a conventional display apparatus is that each visual indicator of the device typically requires a separate current limiting resistor. The use of additional current limiting resistors is undesirable because they increase the cost, size and the power consumption required by the IC package that supports them. In other words, as the number of current limiting resistors increase, so will the cost for an IC package that can accommodate the size and power constraints for operating the same.

Still another factor of a conventional display apparatus is that the amount of power used to illuminate each visual indicator does not change. Therefore, a lighter colored visual indicator is more difficult to see by a user when active than a darker colored visual indicator.

In summary, each additional pin or current limiting resistor required to drive the visual indicators of a conventional electronic device eliminates other possible functions that the pins of the IC for the display apparatus could be used for, or forces the use of larger and more expensive IC packages to drive the display apparatus. In addition, conventional display apparatuses can not be adjusted to provide more power to lighter colored visual indicators of a device so that they may be as recognizable as a darker visual indicator of the same display apparatus.

Accordingly, it would be beneficial to develop an improved display element or apparatus for an electronic device that: requires a single integrated circuit output pin to selectively drive or illuminate two visual indicators; is constructed with a single current limiting resistor to drive two independent visual indicators so that the power consumption, cost and size of the circuit for operating the same can be reduced; and can selectively supply more power to lighter colored visual indicators to increase their visibility.

SUMMARY OF THE INVENTION

In one embodiment of the invention an apparatus is provided for independently illuminating two independent visual indicators with a single control line. The apparatus includes two visual indicators, a logic circuit and an inverting amplifier. The two visual indicators connect in parallel with the cathode to anode direction of one indicator being opposite the other indicator. The inverting amplifier couples between the single control line of the logic circuit and a first and second end of the two indicators, wherein a combination of signals applied to two inputs of the logic circuit selectively creates a single output signal at the single control line to illuminate one of the two indicators.

In another embodiment of the present invention, a process is disclosed for controlling the illumination of two independent visual indicators with a single control line coupled to a logic circuit. The process includes simultaneously providing one of a HIGH and a LOW signal to a first and second input of the logic circuit to create one output on the single control line for controlling the illumination of one of the two indicators. A low signal applied to the first input fails to illuminate either of the two indicators, and a high signal applied to the first input illuminates one of the two indicators.

BRIEF DESCRIPTION OF THE DRAWINGS

These and other objects of the invention will be apparent from the following detailed description in connection with the attached drawings, in which.

Figure 1:
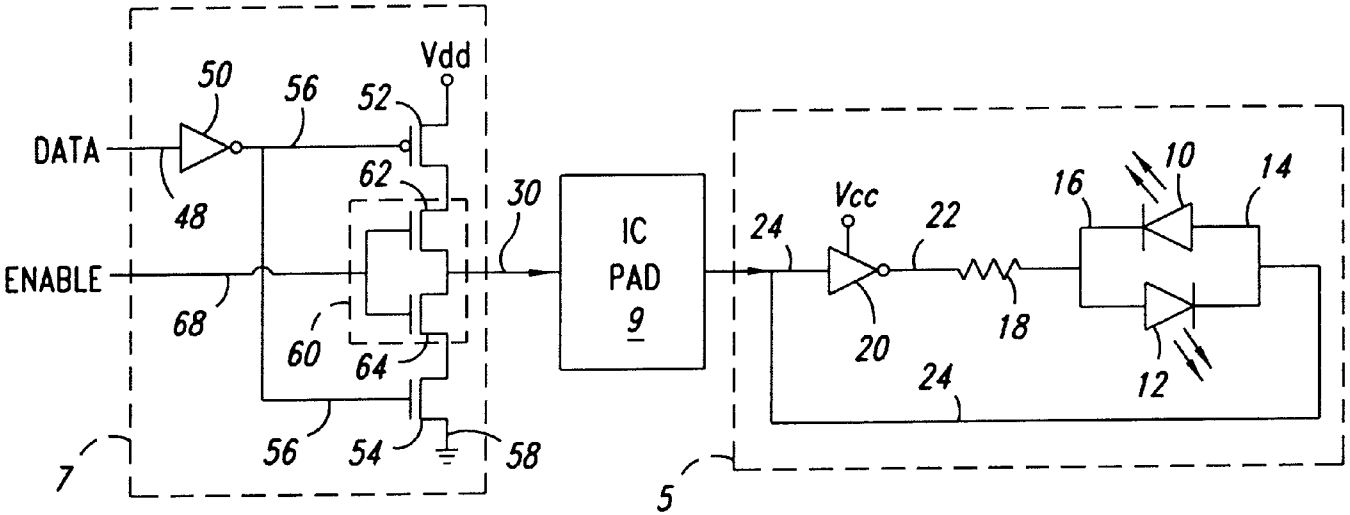
FIG. 1 is a schematic circuit diagram of a display apparatus embodying the present invention.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE INVENTION

Broadly stated, the display element or apparatus of the present invention includes a pair of indicator lights that are adapted to be selectively turned on and off with a signal level applied on a single control line. The ability to control the operation of two indicator lights with a single control line minimizes the number of output pins that are used from an electronic integrated circuit. Moreover, the present invention provides a unique amplifier that either increases the voltage and/or current to at least one of the LED's from the single control line. This enables the LED's to be brighter (more current) or cheaper (requiring higher voltage) than before, and removes the burden of having to provide more current or higher voltages at the control line to illuminate the LED's.

Turning now to the Drawings, FIG. 1 illustrates a circuit diagram in accordance with a preferred embodiment of the present invention. Generally, the illustrated circuit diagram provides a display drive circuit 5 connected to a logic circuit 7 having an IC pad 9 connected therebetween. With this arrangement, only one conductive control line from the IC pad 9 is necessary to operate the drive circuit 5 with the logic circuit 7.

The drive circuit 5 includes a pair of visual indicators that are preferably light emitting diodes (LEDs) 10 and 12 coupled in parallel. In particular, the anode of LED 10 and the cathode of LED 12 connect by line 14. Similarly, the cathode of LED 10 and the anode of LED 12 connect by line 16. With this parallel configuration, a first end of a single current limiting resistor 18 connects to line 16 and a second end connects to the output of an inverting amplifier 20, via line 22. The input of the inverting amplifier 20 connects to the line 14 and the IC pad 9 by the single control line 24. A skilled artisan will appreciate that the inverting amplifier 20 acts as an amplifier in the drive circuit 5 to increase the current/voltage from the control line 24 to the LED 12 during operation.

The IC pad 9 plus logic circuit structure 7 is preferably a standard output buffer having three output states, which are identified as Drive-High, Drive-Low and Drive-Disable. In this preferred embodiment, the output states provide either an approximate voltage level of Vdd or Ground to the control line 24 for illuminating LEDs 10 and 12. The components of the logic circuit structure 7 of FIG. 1 includes an inverter 50 connected between a DATA signal input line 48 and the gates of the transistors 52 and 54, via line 56. The source of transistor 52 connects to a voltage supply Vdd, and the drain of transistor 54 connects to a ground terminal 58. A conventional logic enable or pass gate 60, comprising serially coupled transistors 62 and 64, creates a serial connection from the drain of transistor 52 to the source of transistor 54. As mentioned above, the output of the logic pass gate 60 connects to the input of the IC pad 9, via the output line 30. The input of the logic pass gate 60 supplies the gates of transistors 62 and 64 with an ENABLE signal, via input line 68.

Generally, a HIGH signal applied to DATA line 48 will switch transistor 52 into a conductive state ("ON") and switch transistor 54 into a non-conductive state ("OFF"). Conversely, a LOW signal applied to DATA line 48 will switch transistor 52 OFF and switch transistor 54 ON. However, as will be discussed in more detail below, current will only flow through either transistor 52 or 54 to the IC pad 9, via transistors 62 and 64 respectively, if the signal applied to the ENABLE line 68 is HIGH to activate the gates of the transistors 62 and 64.

To better understand the operation and functionality of the inventive circuitry shown in FIG. 1, reference will now be provided in view of Table 1.

TABLE 1

| DATA Line 48 | ENABLE Line 68 | PAD STATE | IC pad 9 | Inverter 20 | Diode 10 | Diode 12 |
|---|---|---|---|---|---|---|
| "Don't Care" | LOW | Disable-Drive | "float" | Gnd | OFF | OFF |
| LOW | HIGH | Drive-LOW | Gnd | Vcc | OFF | ON |
| HIGH | HIGH | Drive-HIGH | Vdd | Gnd | ON | OFF |
| CLOCK | HIGH | Drive-HIGH, Drive-LOW | Vdd/ Gnd | Gnd/ Vcc | ON | ON |

When the ENABLE line 68 receives a LOW signal input, transistors 62 and 64 switch OFF to a "Don't Care" DATA condition. Therefore, no current flows through the transistors 62 and 64 of the logic pass gate 60, and the IC pad 9 is floating. In other words, no current is available at the IC pad to complete the circuit, so the output of the inverting amplifier 20 is irrelevant since both LEDs 10 and 12 are OFF regardless of the DATA signal applied on line 48. Thus, a DATA "don't care" condition occurs when the signal applied to the ENABLE line 68 is LOW.

When the ENABLE line 68 receives a HIGH signal input, transistors 62 and 64 switch to an ON state, and a selected one of the LEDs 10 and 12 illuminate. The state of the input received by the DATA line 48 determines which LED will illuminate or turn ON. Thus, for the remaining state conditions in Table 1, it will be assumed that the ENABLE line 68 is only receiving a HIGH signal input while the DATA line 48 receives a HIGH or LOW signal input.

When the DATA line 48 receives a LOW signal input (i.e., ENABLE line 68 provides a HIGH signal input), the output of the inverter 50 provides a HIGH signal input to the gate of transistor 54. This HIGH signal input creates a conductive path through the transistor 54 so that current flows from the IC pad 9, through transistors 64 and 54, to the Ground terminal 58. At this time, the IC pad 9 provides a LOW output level, approximately at a ground state, to line 24. The low output level on line 24 reverse biases the LED 10 to be OFF and allows the inverting amplifier 20 to provide an output of Vcc. The Ground to Vcc differential created on line 22 properly forward biases LED 12, via resistor 18, to an ON or illumination state.

When the DATA line 48 receives a HIGH signal input (i.e., ENABLE line 68 provides a HIGH signal input), transistor 52 switches ON and transistor 54 switches OFF. Consequently, current flows from power supply Vdd, through transistors 52 and 62 and IC pad 9, to control line 30. The high voltage of Vdd minus any parasitic values moves through the inverting amplifier 20 to provide a low output to resister 18. At the same time, the Vdd to Ground differential on lines 24 and 14 will forward bias LED 10 to an ON or an illuminant state. The LED 12 is reverse biased to an OFF state.

With the above embodiment of FIG. 1, a preferred application of the drive circuit 5 would utilize a dark color, e.g. green, red, blue, etc., or lower threshold voltage visual indicator for LED 10, and a light color, e.g. yellow, orange, white, etc., or higher threshold voltage visual indicator for LED 12. This will allow the inverting amplifier 20 to increase the brightness of the colored LED 12 that would be typically harder to recognize when active in a conventional display apparatus.

As mentioned earlier, conventional display apparatuses typically provide an equal amount of power to illuminate any visual indicator that is connected to an electronic device. Unfortunately, with this known configuration, lighter colored LEDs, e.g. yellow, are much harder and sometimes impossible to see when active. With the inventive circuit structure recited above, the lighter colored LEDs can be provided to obtain an amplified signal so that a user can easily recognize when the same is illuminated.

Figure 2:
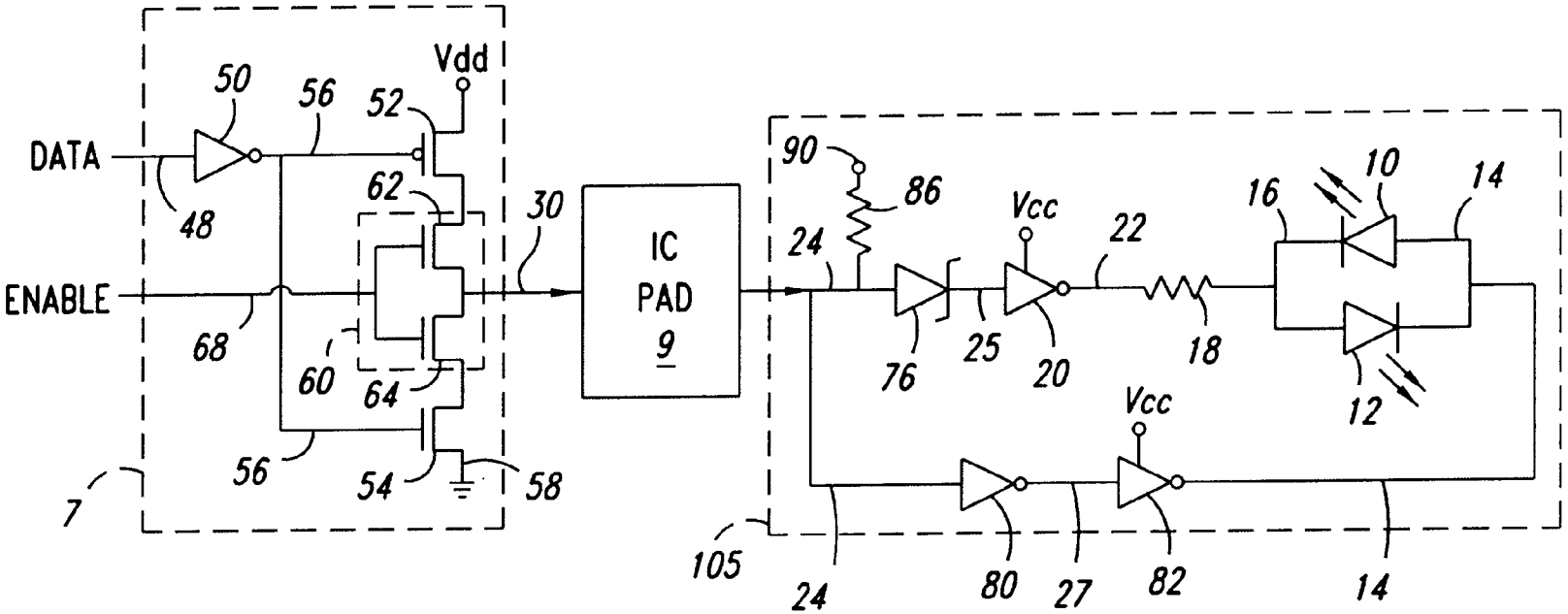
FIG. 2 is an alternative schematic circuit diagram of a display apparatus embodying the present invention.

Referring now to FIG. 2, another embodiment of the present invention is illustrated. Generally, this structure provides the same components as the above embodiment—a single control line 24 coupled between a drive circuit 105 and a logic circuit 7 having an IC pad 9. Consequently, the same reference numbers used to call out components illustrated in FIG. 1 will be used for the following embodiment of FIG. 2.

Although the logic circuit 7 and IC pad 9 for this embodiment may be identical to those used with the embodiment illustrated in FIG. 1, the configuration and operation of the drive circuit 105 has changed slightly from FIG. 1. Building from the inventive embodiment illustrated in FIG. 1, the embodiment of FIG. 2 includes a zener diode 76, two serially connected inverters 80 and 82, and a pull-up resistor 86. In particular, the cathode of the zener diode 76 connects to the input of the inverting amplifier 20 and the anode of the zener diode 76 connects to the output terminal or single control line 24 of the IC pad 9.

The output of inverting amplifier 20 connects to a first end of the two indicators 10 and 12 coupled in parallel at the line 12, via resistor 18. The input of inverter 80 connects to the control line and the input of zener diode 76, and the output of inverter 80 connects to the input of inverting amplifier 82. The output of inverting amplifier 82 connects to the two visual indicators 10 and 12 at the second end, via line 14. Lastly, a pull-up resistor 86 connects to the output line 24 at one end and to a power source 90 at the other end.

As with the embodiment of FIG. 1, the zener diode 76, inverter 80, and the pull-up resistor 86 work with the inverting amplifiers 20 and 82 to raise the voltage driven to Vcc and amplify the current from the control line to the operational LED 10 or 12. To do this, the turn-on voltage Vz of zener diode 76 should be less than or equal to Vdd divided by 2, and the power source 90, coupled to the pull-up resistor 86, should provide a voltage that is less than or equal to Vz.

To better understand the operation and functionality of the inventive circuitry shown in FIG. 2, reference will now be provided in view of Table 2.

TABLE 2

| DATA Line 48 | ENABLE line 68 | PAD STATE | Zener Diode 76 | Inverter 20 | Inverter 82 | Diode 10 | Diode 12 |
|---|---|---|---|---|---|---|---|
| "Don't Care" | LOW | Disable-Drive | OFF | Vcc | Vcc | OFF | OFF |
| LOW | HIGH | Drive-LOW | OFF | Vcc | Gnd | OFF | ON |
| HIGH | HIGH | Drive-HIGH | ON | Gnd | Vcc | ON | OFF |
| CLOCK | HIGH | Drive-HIGH, Drive-LOW | ON | Vcc | Vcc | ON | ON |

As above, when the ENABLE line 68 receives a LOW signal input, transistors 62 and 64 switch OFF to a "Don't Care" DATA condition. With this condition, no current flows through the transistors 62 and 64 of the logic pass gate 60. In addition, the IC pad 9 is biased to some value greater than $V_{LL}$ (the turn on voltage of the inverter 80) and less than Vz (the turn on voltage of the zener diode 76) at the inputs of the inverter 80 and zener diode 76, via the pull-up resistor 86. In other words, the zener diode 76 will not be forward biased, and hence OFF, and the input to inverting amplifiers 20 and 82 will be LOW. This LOW input will provide outputs of HIGH or Vcc at the outputs of inverting amplifiers 20 and 82. Consequently, the two LED's 10 and 12 will not be illuminated or forward biased, hence OFF.

In contrast, when the ENABLE line 68 receives a HIGH signal input, transistors 62 and 64 switch to an ON state, and a selected one of the LEDs 10 and 12 is illuminated depending on the input signal received at the DATA line 48. Thus, for the remaining state conditions of Table 2, the ENABLE line 68 will provide a HIGH signal input.

When the DATA line 48 receives a LOW signal input (i.e., ENABLE line 68 provides a HIGH signal input), current flows to the Ground terminal 58 of the logic circuit 7 from the IC pad 9, via transistors 64 and 54. At such time, the IC pad 9 provides a ground state plus any parasitic resistance, the zener diode 76 will not be properly forward biased, and the inputs to the inverting amplifier 20 and inverter 80 will be LOW. With the inputs to inverters 20 and 80 LOW, their outputs will be HIGH or Vcc. The HIGH output from the inverting amplifier 20 will forward bias the LED 12 to an ON or illumination state, via current limiting resister 18. The LOW output of the inverting amplifier 82 will reverse bias LED 10 to an OFF state.

When the DATA line 48 receives a HIGH signal input (i.e., ENABLE line 68 provides a HIGH signal input), transistor 52 switches ON and transistor 54 switches OFF. While transistor 52 is ON, current flows through transistors 52 and 62, via power supply Vdd, to output line 30 and IC pad 9. The IC pad 9 provides a voltage similar to Vdd to the zener diode 76 and the inverter 80, via control line 24. Since this voltage is greater than the turn-on voltage of the zener diode 76 (i.e., Vz<Vdd/2) and the inverter 80 (i.e., $V_{LL}$), the zener diode 76 and the inverter 80 is properly forward biased to be ON.

With HIGH inputs to the inverting amplifier 20 and inverter 80, their outputs are LOW. When the inverting amplifier 82 receives the low input, it will provide a HIGH output similar to Vcc. This HIGH output will properly forward bias LED 10 to an ON or illumination state and reverse bias LED 12 to an OFF state. As before, the resistor 18 operates as a current limiter for the drive circuit 105.

The inventive display elements or apparatuses described above may be used in any application requiring the independent control of two indicator lights. For example, a useful application of the present invention may be selected from the group including a computer, a scanner, a print server, a signal transmitting and/or receiving device (e.g., modem, pager, cellular phone, remote control), a control panel, etc. However, according to a preferred embodiment, the inventive display apparatus will be incorporated in a print server.

For either of the inventive embodiments described above and illustrated in FIGS. 1 and 2 respectively, a person of ordinary skill in the relevant arts should appreciate that both LEDs 10 and 12 may not be simultaneously illuminated due to their opposite biasing in the above circuit. However, as a result of how the human eye and mind perceives an image, both LEDs 10 and 12 will appear to be simultaneously illuminated if the DATA line 48 receives an alternating HIGH and LOW signal input at a sufficiently high rate. Thus, for example, if the DATA signal input is toggled HIGH and LOW at a CLOCK signal rate that provides roughly a 50/50 duty cycle at approximately 60 Hz, it will appear that both LEDs 10 and 12 are simultaneously illuminated.

The signal inputs received at the DATA and ENABLE lines 48 and 68 can be controlled to keep the intensity or brightness of the LEDs 10 and 12 at a maximum and relative constant. This is accomplished by using the three DATA states to drive the ENABLE line 68 with the clock signal when the DATA line 48 receives either a HIGH or LOW signal input. In addition, with the above alternating signal input operation, the power consumption should not exceed that of a single conventional drive circuit.

Figure 3:
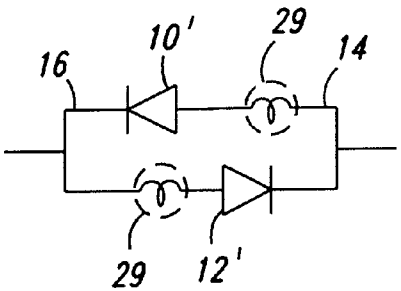
FIG. 3 is an alternative schematic circuit diagram of the visual indicators used with the circuits of FIGS. 1 and 2.

The skilled artisan should also appreciate that the indicator lights or LEDs 10 and 12 of either embodiment may be formed of a standard diode 10' or 12' connected in series with a lamp 29 as shown in FIG. 3. In addition, the LEDs 10 and 12 may be separately formed, or may be provided in a single unitary package. Consequently, the components of the drive circuits 5 and 105 are preferably located external to the logic circuit 7 of the related display apparatus of an electronic device.

The inverting amplifiers 20 and 82 for the above embodiments may be as simple as 2 resistors plus a BJT configured as a conventional RTL logic circuit up through today's fully integrated digital logic inverter. The only significant requirement is that the inverting amplifier chosen can be made compatible with the IC pad 9 such that: the IC pad voltage Voh is greater than the voltage Vih for each inverting amplifier, the IC pad voltage Vol is less then the voltage Vil for each inverting amplifier, and a decent separation and rudimentary hysterisis is created between Vih & Vil for the drive circuit 105. The voltage "amplification" is accomplished if Vcc of the inverting amplifier is greater than Vdd of the ASIC.

The functional components that make-up the logic circuit 7 and IC pad 9 in the above embodiments is just one of many possible representations of what is collectivly know in the industry as a "tri-stateable output buffer" or an "output buffer with enable" circuit. These circuits are available from most ASIC vendors. The present invention uses the "basic" output characteristics of such a circuit to enable the unique amplification and LED driver or drive circuits 5 and 105.

The transistors 52, 54, 62 and 64 illustrated in the logic circuit of FIGS. 1 and 2 are preferably CMOS transistors. However, persons of ordinary skill in the relevant arts should appreciate that other types of transistors or other configurations of logic elements could be used to carry out the operation of the logic circuit 7, i.e., to provide the desired signals on control output 30 and control line 24.

From the foregoing, it should be appreciated that an improved display apparatus has been shown and described which offers many advantages and desirable attributes compared to prior art display apparatuses.

For example, the present invention conserves utilization of precious output pins of integrated circuits, in that it can selectively and independently control two visual indicators with a single output pin. In other words, with the above embodiments, two LEDs of nearly any electronic device or application can be independently controlled by one signal on a single control line.

The inventive display apparatus provides a unique amplifier to either increase the voltage and/or current to a select one of both of the LEDs from the IC pad. This enables one or both of the LEDs to be brighter (more current) or cheaper (requiring higher voltage) than before. This removes the burden of more current or higher voltage from the IC pad.

In summary, the inventive circuit designs of the present invention are compact in size, elegant in its simplicity and operation, and miserly in its power consumption. Therefore, a minimal amount of power will be used to highly illuminate one or more of the LED's during operation using a single control pin of an IC.

While various embodiments of the present invention have been shown and described, it should be understood that other modifications, substitutions and alternatives are apparent to one of ordinary skill in the art. Such modifications, substitutions and alternatives can be made without departing from the spirit and scope of the invention, which should be determined from the appended claims.

Various features of the invention are set forth in the appended claims.

What is claimed is:

1. Apparatus for illuminating two visual indicators with one control line, the apparatus comprising:

two visual indicators connected in parallel with the cathode to anode direction of one indicator being opposite the other indicator;

a logic circuit having two signal inputs and one control line, the line being coupled to a first and second end of the two indicators; and an inverter coupled between the line and the second end of the two indicators, wherein a combination of signals applied to the two inputs selectively illuminates one of the two indicators with one signal from the control line.

2. Apparatus of claim 1, wherein the inverter is an inverting amplifier.

3. Apparatus of claim 2, further comprising a resistor connected between the inverter and the second end of the two indicators.

4. Apparatus of claim 1, further comprising an IC pad connected between the two inputs and the control line.

5. Apparatus of claim 4, wherein the IC pad and logic circuit is an ASIC device having an output buffer that can provide three output states to the control line being selected from Drive-High, Drive-Low and Drive-Disable.

6. Apparatus of claim 1, further comprising:

a first resistor connected between the inverter and the second end of the two indicators;

a zener diode connected between the control line and an input of the inverter;

two serially coupled inverters connected between the control line and the first end of the indicators; and a second resistor connected between the control line and a voltage source.

7. Apparatus of claim 6, wherein one of the serially coupled inverters is an inverting amplifier to amplify the signal from the control line and increase the brightness of the visual indicator being illuminated.

8. Apparatus of claim 1, wherein the logic circuit is a device being selected from the group including a microprocessor, an ASIC and an array of logic gates.

9. Apparatus of claim 1, wherein the two indicators and the inverter are contained in a common package separate from the logic circuit.

10. Apparatus of claim 1, wherein the logic circuit further comprising:

a power source;

a ground terminal;

an IC pad having a logic input and output, the logic output being connected to the one control line;

four serially coupled transistors, the source of the first transistor being coupled to the power source, the drain of the fourth transistor being coupled to the ground terminal, the gates of the second and third transistors being coupled to one input of the two inputs, and the drain of the second transistor and the source of the third transistor being coupled to the logic input of the IC pad; and an inverter coupled between the other input of the two inputs and the gates of the first and four transistors.

11. Apparatus of claim 1, wherein the logic circuit comprises a clocking module for providing a clocked signal having a predetermined frequency to alternate the voltage applied to the control line between any two of HIGH, LOW and MEDIUM voltage levels.

12. Apparatus of claim 1, wherein the logic circuit alternates the voltage to the control line between one of high, low, and medium voltage levels to provide a predetermined intensity of illumination within each of the two indicators.

13. Apparatus for controlling the illumination of two visual indicators with a single control line, the apparatus comprising:

two visual indicators connected in parallel with the cathode of each indicator connected to the anode of the other indicator to form a first and a second end;

a logic element having two inputs and a single control line; and an amplifier connected between the first end, the control line and the second end, and wherein one of the two indicators illuminates when the control line provides one of a HIGH and LOW signal.

14. Apparatus of claim 13, wherein the amplifier comprises an inverting amplifier.

15. Apparatus of claim 14, wherein the amplifier further includes a resistor connected between the inverting amplifier and the first end.

16. Apparatus of claim 15, wherein the amplifier further comprises:

a zener diode connected between the control line and the inverting amplifier;

two serially coupled inverters connected between the control line and the second end; and a resistor connected between a voltage source and the control line.

17. Apparatus of claim 16, wherein one of the two serially coupled inverters is an inverting amplifier that amplifies the signal from the control line to increase the brightness of one of the two visual indicators.

18. Apparatus of claim 13, wherein the IC pad selectively provides one of a HIGH, LOW and MEDIUM voltage level on the single control line when combinations of HIGH and LOW signals are received by the two inputs of the logic element.

19. Apparatus of claim 13, wherein the logic circuit provides a disable voltage level to the control line when one of the two logic circuit inputs receives a LOW signal, irrespective of the signal received by the other input.

* * * * *